US007588464B2

(12) United States Patent
Kim

(10) Patent No.: US 7,588,464 B2
(45) Date of Patent: Sep. 15, 2009

(54) SIGNAL CABLE OF ELECTRONIC MACHINE

(76) Inventor: Yong-Up Kim, 611-bunji, Doogyo-ri, Juksan-myun, Yuseong-gu, Ansung-shi, Gyeoggi-do (KR) 456-891

( * ) Notice: Subject to any disclaimer, the term of this patent is extended or adjusted under 35 U.S.C. 154(b) by 0 days.

(21) Appl. No.: 11/939,228

(22) Filed: Nov. 13, 2007

(65) Prior Publication Data

US 2008/0207054 A1 Aug. 28, 2008

(30) Foreign Application Priority Data

Feb. 23, 2007 (KR) ..... 10-2007-0018413
Mar. 6, 2007 (KR) ..... 10-2007-0021739

(51) Int. Cl.
*H01R 13/66* (2006.01)

(52) U.S. Cl. ..... 439/620.05; 439/610

(58) Field of Classification Search ..... 439/607, 439/610, 620.05, 620.06, 620.07, 620.09, 439/620.1
See application file for complete search history.

(56) References Cited

U.S. PATENT DOCUMENTS 6,341,986 B1 * 1/2002 Ko ..... 439/610
6,641,439 B2 * 11/2003 Kim ..... 439/620.05
6,776,665 B2 * 8/2004 Huang ..... 439/676
7,160,153 B1 * 1/2007 Huang ..... 439/610
7,210,947 B1 * 5/2007 Fodero et al. ..... 439/95

* cited by examiner

*Primary Examiner*—Thanh-Tam T Le
(74) *Attorney, Agent, or Firm*—Lowe Hauptman Ham & Berner, LLP

(57) ABSTRACT

The present invention relates to a signal cable of an electronic machine, in which a shield can is constructed in an integral type and a ferrite core is built inside a hood of a connector. In the signal cable of the present invention, the shield can for covering and protecting an insulator and a pin is constructed in an integral type. Therefore, since the shield can has no seamed portion, a shielding effect thereof is excellent, and further the number of unnecessary and complicated processes is considerably reduced. In addition, as the cylindrical ferrite core is built inside the hood of the connector of the signal cable, the process of attaching the ferrite core to the cable is omitted, so that the workability is enhanced, and an effect of blocking electromagnetic waves is also excellent.

1 Claim, 6 Drawing Sheets

SIGNAL CABLE OF ELECTRONIC MACHINE

CROSS-REFERENCE TO RELATED APPLICATION

This application claims the benefit of Korean Patent Application No. 2007-0021739, filed on Mar. 6, 2007, the disclosure of which is hereby incorporated herein by reference in its entirety.

BACKGROUND OF THE INVENTION

1. Field of the Invention

The present invention relates to a signal cable for connecting electronic machines, and more specifically, to a signal cable in which the shape of a shield can (a so-called steel cap) built inside a connector is improved, and a cylindrical ferrite core is built inside the connector.

2. Description of the Related Art

In general, a conventional signal cable is constructed in a manner shown in FIG. 2. That is, a pin to which an insulator 30 and a core wire 40 are connected is built inside a metallic shell 20, a shield can composed of an upper cap 50 and a lower cap 60 is attached to the rear side of the metallic shell 20, and a hood 70 covers the shield can.

However, when the shield can is divided into the upper and lower caps, a variety of processes should be performed for reliable shielding. For example, the shield can is wrapped with paper, a copper tape is wound around the shield can a plurality of times, and soldering is performed to close a minute gap between layers of the wound tape.

In particular, since the soldering is performed in a state where the core wire is present, various defects may occur. For example, the core wire may be short-circuited by heat caused by the soldering. Further, since a variety of unnecessary and complicated processes should be carried out, productivity decreases, and a manufacturing cost increases.

Meanwhile, a ferrite core is attached to the connector of the signal cable, in order to block unnecessary electromagnetic waves flowing in from outside. In the related art, a ferrite core 80 is inserted into the outside of the cable, and an outer circumferential surface (outer shell) of the ferrite core 80 is fixed and bonded by PVC, as shown in FIG. 1. Therefore, the appearance of the signal cable is degraded. Further, when an electronic machine such as a computer is installed, the cable is connected to the rear of the computer. In this case, since the cable is not smoothly curved because of the cylindrical ferrite core mounted on the cable, a predetermined space should be secured behind the computer.

That is, to connect the core wire 40 to the pin 90, various insulation coverings such as braiding, aluminum foil and the like, which cover the core wire 40, should be all peeled off. The peeled portion of the core wire 40 does not contribute to blocking harmful electromagnetic waves.

Therefore, as the ferrite core for blocking harmful electromagnetic waves is positioned adjacent to the peeled portion of the core wire, the shielding effect increases.

However, if the ferrite core 80 is attached immediately behind the connector so as to be positioned adjacent to the connector, and when an electronic machine is installed, the cable is not smoothly curved because of the cylindrical ferrite core mounted on the cable. Therefore, a predetermined space should be secured behind the electronic machine.

To solve such a problem, the present applicant has disclosed a D-sub connector having a ferrite core built therein (Korean Utility Model Patent No. 102248), in which a ferrite core is built inside a D-sub metallic shell. The workability thereof is excellent, compared with when the cylindrical ferrite core is attached to the conventional cable. However, an additional operation is required for mounting the ferrite core into the metallic shell, and the size of the ferrite core is inevitably reduced. Therefore, it is difficult to expect the maximum effect.

SUMMARY OF THE INVENTION

The present invention provides a signal cable of an electronic machine, in which a shield can is constructed in an integral type and a ferrite core is built inside a hood of a connector. Therefore, the connector can be easily assembled so that the number of complicated processes is considerably reduced. Further, harmful electromagnetic waves are effectively blocked.

According to an aspect of the present invention, a signal cable of an electronic machine includes a connector formed in either end thereof, the connector including: a metallic shell having an insulator and a pin built therein; a shield can for covering a rear portion of the metallic shell; and a hood for covering the shield can. The shield can of the connector is constructed in an integral type which has no seamed portion, the shield can has a concave groove formed in either side surface thereof, a protrusion corresponding to the concave groove is formed on an inner wall of the hood such that the shield can is inserted into the hood, and a cylindrical ferrite core is built inside the hood.

The cylindrical ferrite core may be positioned in the rear side of the shield can or inside the shield can.

BRIEF DESCRIPTION OF THE DRAWINGS

The above and other features of the present invention will be described in reference to certain exemplary embodiments thereof with reference to the attached drawings in which.

DETAILED DESCRIPTION OF THE INVENTION

Figure 1:
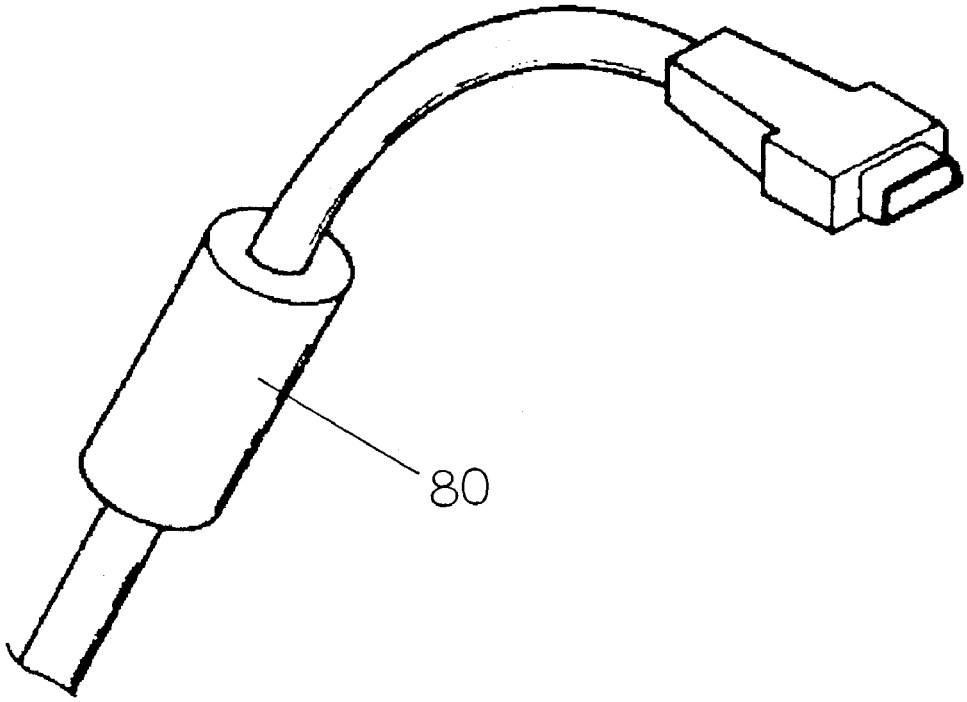
FIG. 1 (PRIOR ART)
FIG. 1 is a diagram of a conventional signal cable.

The present invention will now be described more fully hereinafter with reference to the accompanying drawings, in which exemplary embodiments of the invention are shown. This invention may, however, be embodied in different forms and should not be construed as limited to the embodiments set forth herein. Like numbers refer to like elements throughout the specification.

Main features of a cable 10 according to the present invention are as follows. Firstly, a shield can 11 for covering and protecting a pin 90, to which an insulator 30 and a core wire 40 built in a connector of the cable 10 are connected, is constructed in an integral type. Secondly, when a cylindrical ferrite core 15 or 16 is attached to a cable line, it is attached to the inside of a hood 13 of the connector.

Figure 2:
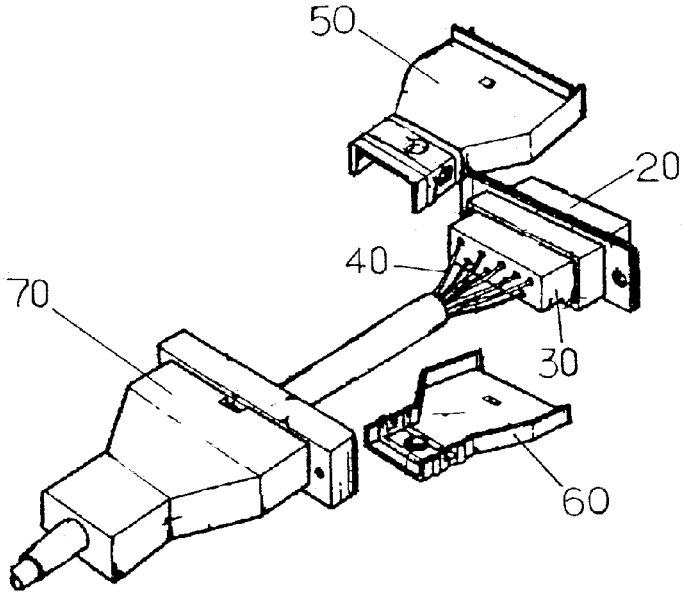
FIG. 2 (PRIOR ART)
FIG. 2 is a diagram of another conventional signal cable.

First, the shield can 11 will be described, which is an essential part of the present invention. Conventionally, the shield can is composed of the upper cap 50 and the lower cap 60, which are assembled and then used, as shown in FIG. 2.

Figure 3:
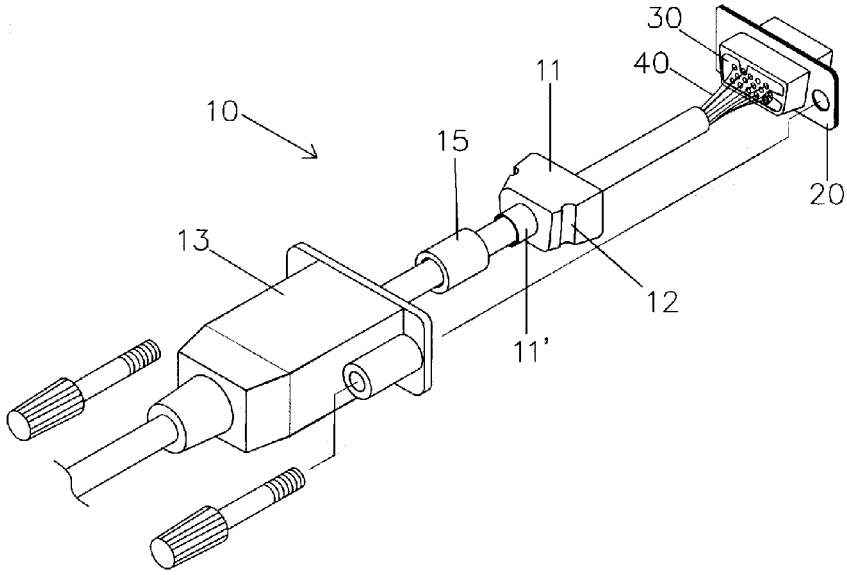
FIG. 3 is an exploded perspective view of a signal cable according to an exemplary embodiment of the present invention.

However, the shield can 11 of the present invention is constructed in an integral type, which has no seamed portion, as shown in FIG. 3.

Therefore, the shield can 11 does not need to be assembled, because it is not divided into the upper and lower caps, unlike that of the related art. Further, since the shield can 11 has no seamed portion, shielding is perfectly achieved.

In the related art, the shield can is divided into the upper and lower caps, and the upper and lower caps are assembled. Therefore, since the shield has a seamed portion, shielding is not perfectly achieved.

To solve the problem, complicated processes are performed in the related art. For example, separate paper and copper tape are wound around the insulator and the core wire, before the insulator and the core wire are covered by the upper and lower caps. Further, welding is performed.

In the present invention, however, the shield can 11 is constructed in an integral type, which has no seamed portion. Therefore, it is possible to perfectly solve the problem.

Meanwhile, a concave groove 12 is formed in either side of the shield can 11, and a protrusion 14 is formed in a portion corresponding to the concave groove 12, that is, on an inner wall of the hood 13 into which the shield can 11 is inserted. Therefore, when the shield can 11 is inserted into the hood 13, the shield can 11 is prevented from easily coming off Further, when an end 11' of the shield can 11 is pressed against the cable line during installation, the shield can 11 is reliably attached to the cable 10, and simultaneously, a connection portion of the core wire built in a metallic shell is reliably protected.

Next, the ferrite core 15 and 16 will be described.

In the present invention, the cylindrical ferrite core 15 or 16 is built inside the hood 13 such that a shielding effect is maximized.

To connect the core wire 40 to the pin 90, various insulation coverings (braiding, aluminum foil and the like) which cover the core wire should be all peeled off. Therefore, the peeled portion of the core wire does not contribute to blocking harmful electromagnetic waves.

Accordingly, as the ferrite core for blocking harmful electromagnetic waves are positioned adjacent to the peeled portion of the core wire, the shielding effect increases.

In the related art, the cylindrical ferrite core 80 is inserted into the outside of the cable, and the outer circumferential surface (outer shell) thereof is fixed and bonded by PVC, as shown in FIG. 1. Therefore, the ferrite core cannot be positioned adjacent to the connector.

That is, if the ferrite core 80 is attached immediately behind the connector so as to be positioned adjacent to the connector, and when an electronic machine (such as a computer) is installed, a portion of the cable where the ferrite core is mounted is not smoothly curved. In this case, a predetermined space should be secured behind the electronic machine.

In the present invention, however, the peeled portion of the core wire in which the insulator coverings are all peeled off to connect the core wire to the pin, i.e., the ferrite core 15 or 16, is positioned inside the hood 13. Therefore, it is possible to solve the defect of the related art.

Figure 4:
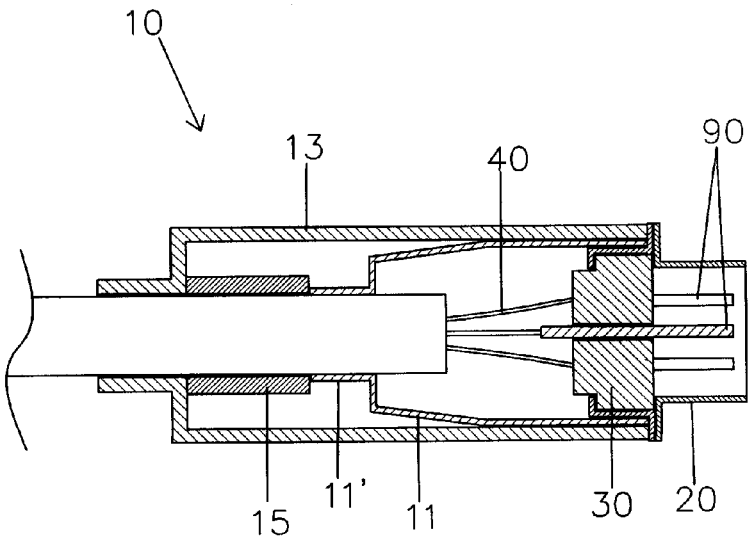
FIG. 4 is a cross-sectional view of the signal cable of FIG. 3.
Figure 5:
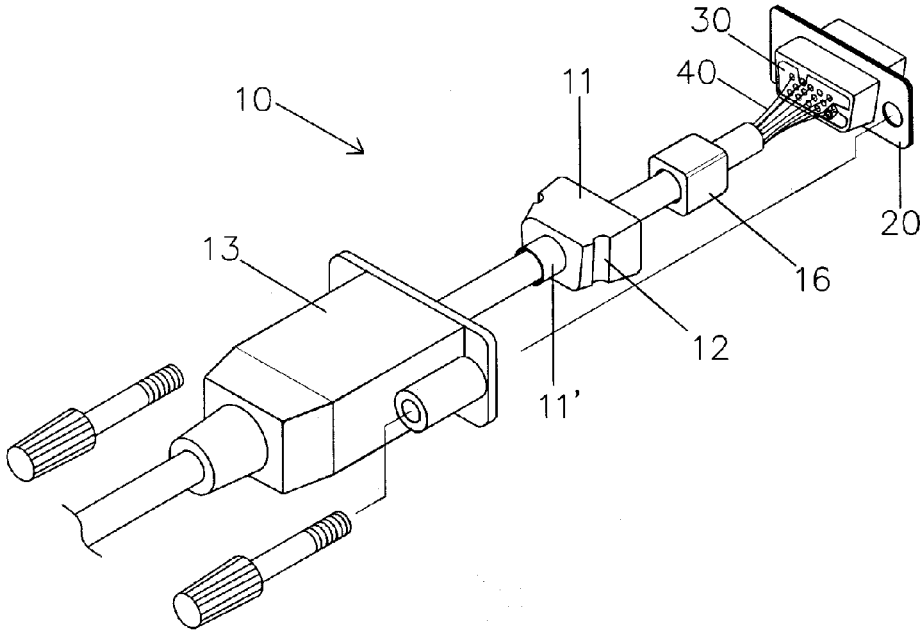
FIG. 5 is an exploded perspective view of a signal cable according to another exemplary embodiment of the present invention.
Figure 6:
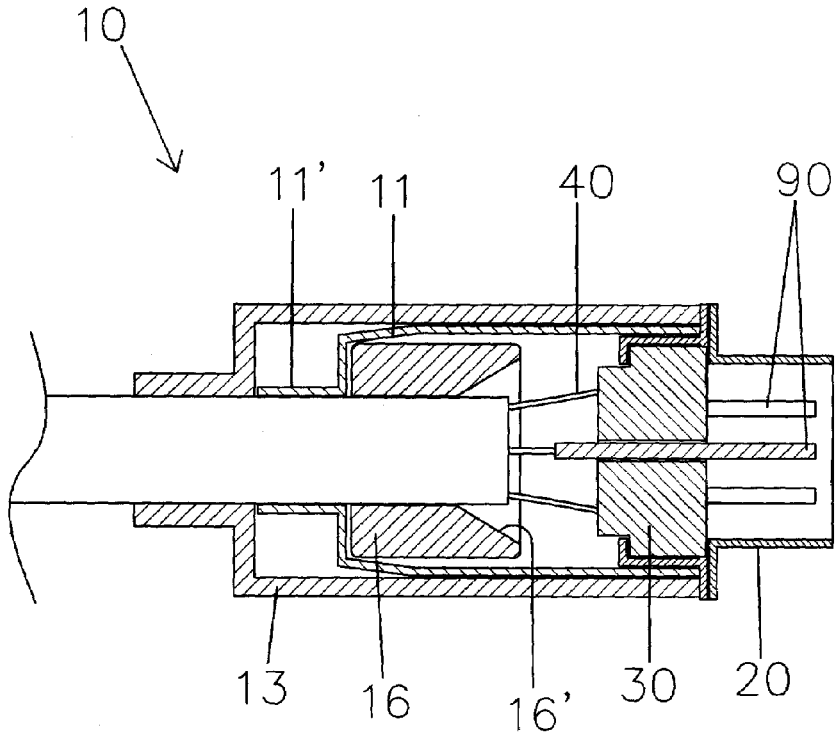
FIG. 6 is a cross-sectional view of the signal cable of FIG. 5.
Figure 7:
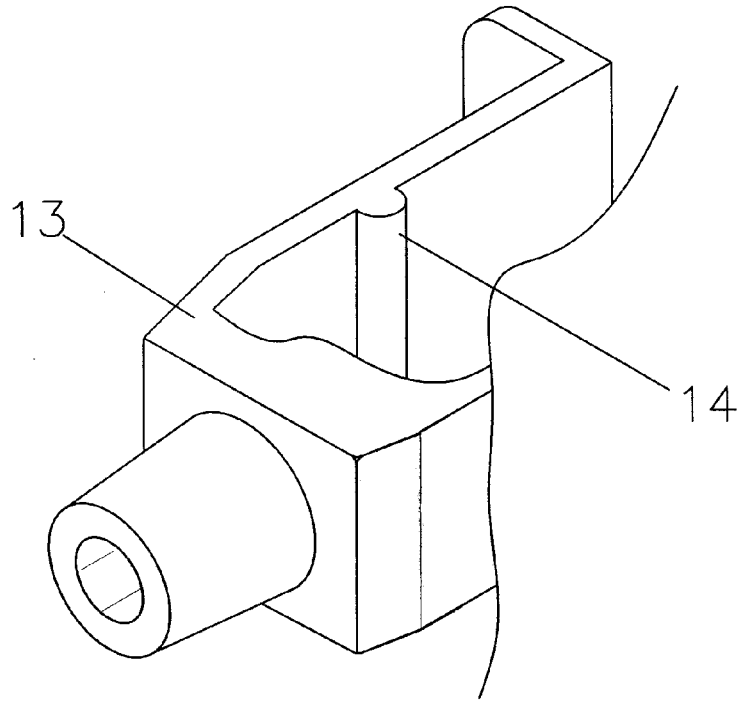
FIG. 7 is a perspective view illustrating the inside of a hood which is an essential part of the present invention.

Meanwhile, when the cylindrical ferrite core 15 or 16 is built inside the hood 13, the ferrite core 16 may be built inside the shield can 11, as shown in FIGS. 5 and 6, and the ferrite core 15 may be built in the rear side outside the shield can 11, as shown in FIGS. 3 and 4. In any case, the ferrite core is positioned in the vicinity of the peeled portion of the core wire where the insulator coverings are peeled off. Therefore, the shielding effect is more excellent than in the related art.

Further, the ferrite core 16 built inside the shield can 11 has a leading end portion formed in a funnel shape, the leading end portion facing the core wire. Therefore, the leading end portion of the ferrite core 16 has a large inner diameter. When the core wires are inserted into the pin, the distances between the core wires are widened. Therefore, a predetermined space is needed in front of the ferrite core 16.

Figure 8:
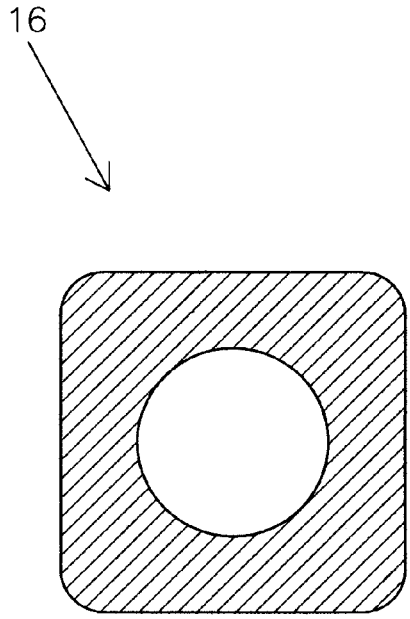
FIG. 8 is a cross-sectional view of another example of a ferrite core according to the present invention.
Figure 9:
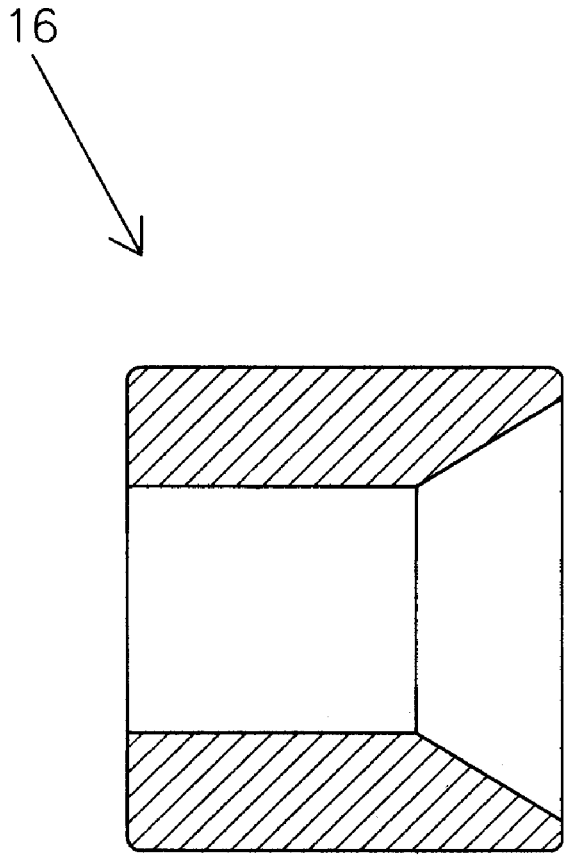
FIG. 9 is a longitudinal sectional view of another example of a ferrite core according to the present invention.

Further, as shown in FIGS. 8 and 9, the ferrite core 16 is constructed in such a manner that the cross-section thereof is substantially formed in a rectangle. In such a structure, the ferrite core has a larger thickness, thereby obtaining a more excellent shielding effect.

According to the present invention, since the shield can for covering and protecting the insulator and the pin is constructed as one integral type, it has no seamed portion. Therefore, the shielding effect is excellent. Further, since a variety of complicated processes in the related art do not need to be performed, workability is enhanced.

In the related art, various defects occur. For example, the core wire may be short-circuited by heat caused by soldering. In the present invention, however, the hood is inserted into the outside of the cable, and the cylindrical ferrite core, the shield can (steel cap) formed in an integral type, and the metallic shell are then assembled. Therefore, inserting injection molding, in which a primary insert, a secondary insert, insulator PVC resin and the like are required, is not necessary. Further, the processes of winding a shield copper tape, soldering and the like are omitted.

In the invention, when a terminal is processed, a stamping method is adopted, in which raw materials are directly connected. Therefore, 64 processes such as a lead wire process for connecting pins, a soldering process and the like are omitted.

Therefore, the number of overall processes is reduced from 160 to 96 (40%). That is, the amount of work is reduced so that productivity is enhanced. Further, manufacturing cost can be considerably reduced.

In particular, the very complicated inserting process and the soldering process are omitted in the present invention. Therefore, although the number of processes is reduced by 40%, an actual amount of work may be reduced by 60-70%, which is a remarkable effect.

Further, since the cylindrical ferrite core is built inside the connector, it is possible to considerably reduce covering materials required when the ferrite core is separately inserted into the outside of the cable. Therefore, consumption of raw materials can be considerably reduced.

Furthermore, the ferrite core is built in the position of the peeled portion of the core wire where the insulator is peeled off to connect the core wire to the pin. Therefore, the effect of blocking electromagnetic waves is more excellent than in an existing cable. Overall, the cable according to the present invention has a more excellent effect than an existing cable.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. A signal cable of an electronic machine comprising a connector formed in either end thereof, the connector including:

a metallic shell having a forward portion and an insulator, and a pin built therein;

a shield can for covering a rear portion of the metallic shell, wherein the shield can is formed in an integral type with no seamed portion, and has a concave groove formed on either side surface thereof;

a hood for covering the shield can, wherein a protrusion corresponding to the concave groove is formed on an inner wall of the hood such that the shield can is inserted into the hood;

a cylindrical ferrite core positioned at a rear side of the shield can and inserted in the hood;

wherein one end of the cylindrical ferrite core adjacent to an end of the shield can and another end of the cylindrical ferrite core adjacent to an inner wall of the hood.

* * * * *